US011272746B2

(12) United States Patent
Davidson

(10) Patent No.: US 11,272,746 B2
(45) Date of Patent: Mar. 15, 2022

(54) METHODS AND SYSTEMS FOR CONFIGURING A BIB WITH AN INFANT CARE ENGAGEMENT BIGHT

(71) Applicant: BooginHead LLC, Issaquah, WA (US)

(72) Inventor: Sari Davidson, Bellevue, WA (US)

(73) Assignee: BOOGINHEAD LLC, Issaquah, WA (US)

( * ) Notice: Subject to any disclaimer, the term of this patent is extended or adjusted under 35 U.S.C. 154(b) by 77 days.

(21) Appl. No.: 16/409,741

(22) Filed: May 10, 2019

(65) Prior Publication Data

US 2019/0320732 A1 Oct. 24, 2019

Related U.S. Application Data

(63) Continuation-in-part of application No. 15/648,195, filed on Jul. 12, 2017, now abandoned.

(60) Provisional application No. 62/366,577, filed on Jul. 25, 2016.

(51) Int. Cl.

| | |
|---|---|
| ***A41B 13/10*** | (2006.01) |
| ***A45F 5/02*** | (2006.01) |
| *A61J 17/00* | (2006.01) |

(52) U.S. Cl.

CPC ..... *A41B 13/10* (2013.01); *A45F 5/02* (2013.01); *A41B 2300/20* (2013.01); *A41B 2400/70* (2013.01); *A41B 2500/20* (2013.01); *A61J 17/1111* (2020.05)

(58) Field of Classification Search

CPC . A41B 13/10; A41B 2300/20; A41B 2400/70; A41B 2500/20; A41B 13/00; A45F 5/02; A45F 2300/002; A45F 2005/008; A61J 17/1111; A61J 17/001; A61J 17/00; A61J 17/007; A61J 17/02; A61J 9/06; A61J 15/0011; A61J 9/0607; A61J 9/0638; A61J 9/0676; A41D 15/00; A41D 11/00; A41D 1/215; A47G 21/165; A61M 2205/59

See application file for complete search history.

(56) References Cited

U.S. PATENT DOCUMENTS

| | | | | | |
|---|---|---|---|---|---|
| 4,604,758 | A * | 8/1986 | Grasberger | A41B 13/10 | 2/49.3 |
| 4,700,408 | A * | 10/1987 | Winger | F16M 13/04 | 24/3.4 |
| 4,719,650 | A * | 1/1988 | Milloy | A61J 17/111 | 2/49.1 |
| 4,776,546 | A * | 10/1988 | Goldson | A61J 9/00 | 224/148.4 |
| 5,312,282 | A * | 5/1994 | Cooper | A61J 17/113 | 446/27 |
| 5,908,439 | A * | 6/1999 | Ford | A61J 17/1111 | 606/234 |
| 5,960,471 | A * | 10/1999 | Burton | A41B 13/103 | 2/48 |
| 6,269,502 | B1 * | 8/2001 | Exstrom | A61J 17/00 | 5/655 |

(Continued)

*Primary Examiner* — Robert H Muromoto, Jr.

(74) *Attorney, Agent, or Firm* — Adam L. K. Philipp; Jonathan E. Olson; Aeon Law

(57) ABSTRACT

A bib assembly is configured with a hanging portion and first and second ends with attachment features for releasable engagement. The hanging portion may, in some variants, include one or more exposed bights configured to engage a pacifier, toy, or other infant care appliance.

14 Claims, 6 Drawing Sheets

(56) References Cited

U.S. PATENT DOCUMENTS 6,428,098 B1 * 8/2002 Allbaugh ..... A47D 1/00 297/219.12
6,732,375 B2 * 5/2004 Nornes ..... A41B 13/10 2/49.1
7,032,248 B1 * 4/2006 Gutilla ..... A41B 13/10 2/49.1
7,086,121 B2 * 8/2006 Lippincott ..... A61J 17/00 24/3.13
7,444,685 B2 * 11/2008 Rose ..... A41B 13/10 2/49.1
7,513,465 B2 * 4/2009 Prado ..... A61J 9/06 248/102
7,640,598 B1 * 1/2010 Mallik ..... A41D 1/215 2/46
8,118,268 B2 * 2/2012 Mabry ..... A47D 13/083 248/105
8,118,364 B2 * 2/2012 Davis ..... A47G 9/068 297/219.12
8,460,053 B2 * 6/2013 Fair ..... B62B 9/26 446/227
8,986,120 B2 * 3/2015 Davidson ..... A63F 13/28 463/36
9,162,813 B2 * 10/2015 Noble ..... A61J 17/111
9,386,806 B2 * 7/2016 Bailey ..... A41B 13/10
9,439,836 B1 * 9/2016 Thomas ..... A61J 17/1012
D810,404 S * 2/2018 Davidson ..... D2/864
9,883,988 B1 * 2/2018 Kumbasi ..... A61J 17/113
D814,748 S * 4/2018 Davidson ..... D2/861
10,080,707 B2 * 9/2018 Dunn ..... A45F 5/02
2002/0104202 A1 * 8/2002 Henry ..... B62B 3/1456 24/306
2003/0014078 A1 * 1/2003 Robbins ..... A61J 17/02 606/235
2003/0168561 A1 * 9/2003 Ortiz ..... A61J 17/111 248/229.1
2004/0079843 A1 * 4/2004 Medwed ..... A61J 9/063 248/104
2004/0244153 A1 * 12/2004 Lippincott ..... A61J 17/111 24/3.13
2005/0217084 A1 * 10/2005 Behn ..... A45F 5/00 24/302
2005/0279136 A1 * 12/2005 Bowman ..... A44C 15/003 63/21
2006/0081487 A1 * 4/2006 Hoelzle ..... A45C 3/00 206/223
2006/0168765 A1 * 8/2006 Beatty ..... A45F 5/02 24/3.13
2006/0168766 A1 * 8/2006 Lippincott ..... A61J 17/111 24/3.13
2007/0027479 A1 * 2/2007 Carter ..... A61J 7/0053 606/234
2007/0061939 A1 * 3/2007 Rose ..... A41B 13/10 2/49.1
2007/0151871 A1 * 7/2007 Brawley ..... A45C 11/24 206/37
2007/0181754 A1 * 8/2007 Prado ..... A61J 17/111 248/102
2008/0005824 A1 * 1/2008 Seckinger ..... A47K 3/001 2/80
2008/0023515 A1 * 1/2008 Coonan ..... B25H 3/00 224/682
2008/0128459 A1 * 6/2008 Ridler ..... A45F 5/00 224/148.6
2008/0134432 A1 * 6/2008 Brandon ..... A47G 9/0223 5/482
2009/0165206 A1 * 7/2009 Davis ..... A47D 15/006 5/494
2009/0320173 A1 * 12/2009 Markowitz ..... A45F 5/02 2/69
2010/0062677 A1 * 3/2010 Savoni ..... A63H 3/005 446/139
2010/0147298 A1 * 6/2010 Loescher ..... A61M 16/049 128/203.22
2010/0170039 A1 * 7/2010 Davis ..... B60N 2/2812 5/494
2011/0258748 A1 * 10/2011 Rosenbaum ..... A61J 17/10 2/49.1
2012/0174279 A1 * 7/2012 Bailey ..... A41B 13/103 2/48
2013/0042379 A1 * 2/2013 Zuccarello ..... A41B 13/10 2/48
2013/0089276 A1 * 4/2013 Noble ..... A61J 17/113 383/42
2013/0239457 A1 * 9/2013 Corbitt, III ..... A01K 83/06 43/42
2015/0066083 A1 * 3/2015 Ramos ..... A61J 17/111 606/235
2015/0150312 A1 * 6/2015 LaHann ..... A41D 1/215 2/49.1
2016/0174640 A1 * 6/2016 Wilkinson ..... A41D 27/20 428/80
2018/0020744 A1 * 1/2018 Davidson ..... A45F 5/02 2/49.1
2018/0103690 A1 * 4/2018 Hyslop ..... A45F 5/02
2018/0153225 A1 * 6/2018 Walsh ..... A41B 13/10

* cited by examiner

METHODS AND SYSTEMS FOR CONFIGURING A BIB WITH AN INFANT CARE ENGAGEMENT BIGHT

BACKGROUND

Infant care imposes so many long-felt needs upon a caregiver that many go overlooked by innovators. Infant care remains difficult notwithstanding innovation, but for those in the trenches conveniences add up. Baby bibs are a ubiquitous solution for protecting clothing but could be more effective than they are for other aspects of infant care.

DETAILED DESCRIPTION

Figure 2:
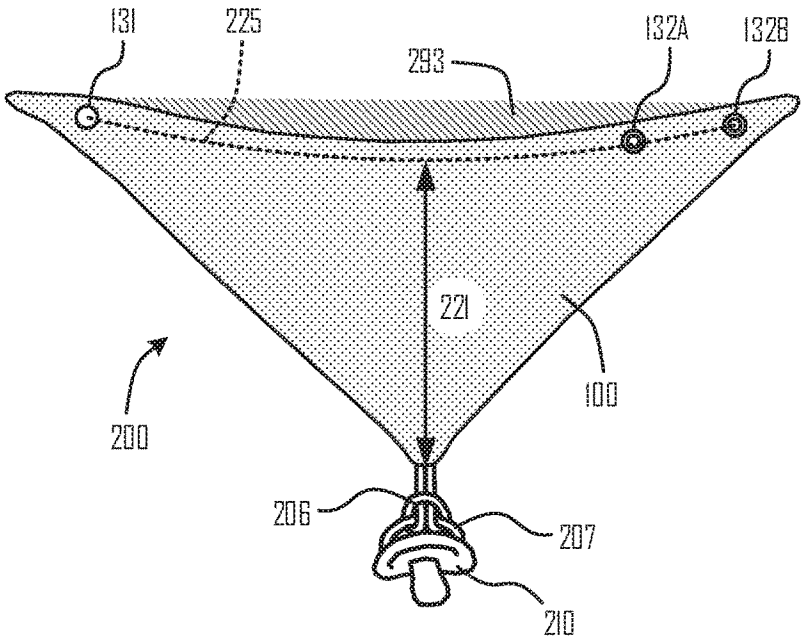
FIG. 2 depicts an infant care system gripping an infant care appliance in accordance with one or more embodiments.

As used herein, the phrases "in one embodiment, "in one or more embodiments," "in various embodiments," "in some embodiments," and the like may be used repeatedly. Such phrases do not necessarily refer to the same embodiment. The terms "comprising," "having," and "including" are synonymous open descriptors except where the context dictates otherwise. The detailed description that follows primarily comprises concisely described, select examples intended to facilitate rapid understanding of content herein that is not widely known.

"Adjacent", "between", "cloth", "complementary", "configured", "containing", "effective," "extending", "first", "gripped", "hanging", "having", "inward", "larger", "longest", "lowest", "machine-washable", "outward", "releasably", "required", "second", "sewn", "significant", "single", "smaller", "stitched", "substantial", "suitable", "through", "wherein," "woven", or other such descriptors herein are used in their normal yes-or-no sense, not merely as terms of degree, unless context dictates otherwise. In light of the present disclosure those skilled in the art will understand from what is meant by "effective" and by other such context-specific descriptors used herein.

Reference is now made in detail to the description of the embodiments as illustrated in the drawings. While embodiments are described in connection with the drawings and related descriptions, it will be appreciated by those of ordinary skill in the art that alternate and/or equivalent implementations may be substituted for the specific embodiments shown and described, including all alternatives, modifications, and equivalents, whether or not explicitly illustrated and/or described, without departing from the scope of the present disclosure. In various alternate embodiments, additional devices, or combinations of illustrated devices, may be added to, or combined, without limiting the scope to the embodiments disclosed herein.

Figure 1:
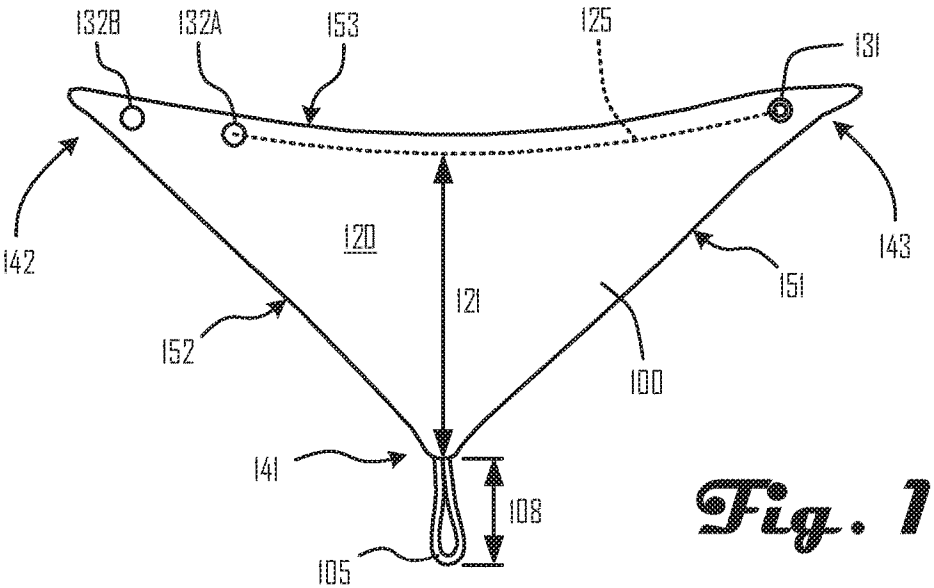
FIG. 1 depicts an infant care system configured to grip an infant care appliance in accordance with one or more embodiments.

Referring now to FIG. 1, there is shown an infant care system 100 in which one or more inventive technologies may be present as described below. Infant care system 100 includes (at least) a bib body 120 having several corners 141, 142, 143 and edges 151, 152, 153 as shown. Extending from a first corner 141 is a part of one or more strands 105 configured to grip an infant care appliance. FIG. 1 also depicts a stud face of a "first" snap side 131 and (a smooth backside of each of) a selection of "second" snap sides 132A-B by which the bib size (effective circumference) can be adjusted. To implement a smaller effective circumference 125, for example, a user presses the stud face of snap side 131 with a socket face of snap side 132B (see FIG. 2) rather than of snap side 132A. Alternatively, the adjustable bib size can be accomplished by other fasteners (buttons or Velcro hook-and-loop structures, e.g.).

When engaged, the smaller effective circumference 125 is between 10 and 14 inches as shown. The effective length 121 of the body 120 (measured from the effective circumference 125 to an endmost point of corner 141, e.g.) is between 6 and 8 inches as shown. The effective length 108 of the part of the one or more strands 105 extending beyond body 120 is between 1 and 4 inches as shown. It is contemplated, however, that any of these parameters may vary outside these ranges.

Referring now to FIG. 2, there is shown an infant care system 200 in which one or more inventive technologies may be present, optionally including an instance of infant care system 100 of FIG. 1 (flipped over and) further including (a pacifier as) an infant care appliance 210 affixed thereto. In some variants, a closed handle or other suitable portion 207 of the appliance 210 may (optionally, in some variants) be gripped by a knot 206. The knot 206 may be a cow hitch (as shown), for example, formed by feeding a bight of strand 105 through the closed handle of the appliance 210 and then passing the appliance through the bight. FIG. 2 also depicts a socket face of a "second" snap side 132B and a smooth backside of the "first" snap sides 231 by which the bib size can be adjusted to implement its larger effective circumference 225. The configuration of snap side 231 with any "second" snap side 232 optionally implements a safety snap assembly (having a release force of 5-20 lbs., e.g.).

When engaged, the larger effective circumference 225 is between 12 and 18 inches as shown, being more than 10% larger than and less than 30% larger than the smaller effective circumference 125 of infant care system 200. The effective length 221 of the body 120 (measured from the effective circumference 225 to a lowest point of corner 141, e.g.) is substantially the same as (within 5%) the effective length 121 shown in FIG. 1.

FIG. 2 also depicts a curved recess 293 (depicted with hashing and positioned along the longest edge 153 of body 120) at least 0.3 inches wide and tapering to a point at each end (adjacent respective corners 142, 143). Such a recess allows the body 120 to assume a saddle shape without substantial tension along its other primary edges 151, 152 thus reducing a tendency for the bib to crease in use.

Figure 3:
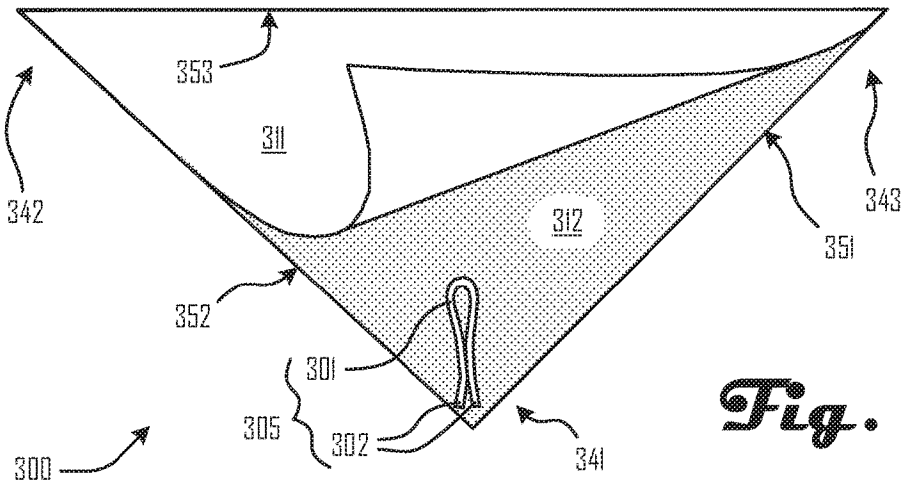
FIG. 3 depicts an in-progress bib assembly, exemplifying a first state of progress in constructing an infant-care system.

Referring now to FIG. 3, there is shown a partial bib assembly 300 in which one or more inventive technologies may (optionally, in some variants) be present as described below, illustrating a first state of progress in constructing the above-described infant care systems 100, 200. Bib assembly 300 includes a first 3-sided piece 311 (unshaded) laid over (at least) a second 3-sided piece 312 (shaded) of flat material (a cotton, microfiber, or other elastic or semi-elastic cloth, e.g.). Each of these pieces 311, 312 includes a first corner 341 associated with a first corner 141 of infant care system 100, a second corner 342 associated with a second corner 142 of infant care system 100, and a third corner 343 associated with a third corner 143 of infant care system 100. Each of these pieces 311, 312 likewise includes a first edge 351 generally aligned along a first edge 151 of infant care system 100, a second edge 352 somewhat generally along a second edge 152 of infant care system 100, and a third edge 353 generally aligned along a third edge 153 of infant care system 100 as shown. Between the pieces 311, 312 of material is one or more strands 305 (each having one or more inward-extending bights 301 and outward-extending ends 302, e.g.) that can become like the infant care system 100 of FIG. 1.

Figure 4:
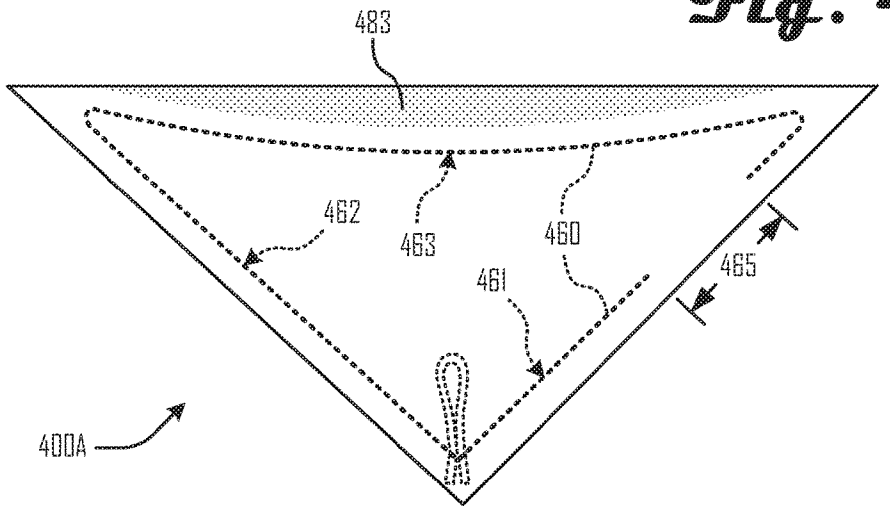
FIG. 4 depicts a bib assembly exemplifying a second state of progress more advanced than that of FIG. 3.

Referring now to FIG. 4, there is shown a bib assembly 400 in a second state of progress, more advanced than that of FIG. 3. Stitching 460 has been applied so as to define three primary sides 461, 462, 463 of which a longest side 463 has a concave curvature along most or all of its length (including a surplus of peripheral material 483 to be removed as described below, e.g.). Also one of its sides has a gap 465 in stitching 460 that is longer than 1 inch, further described below.

Figure 5:
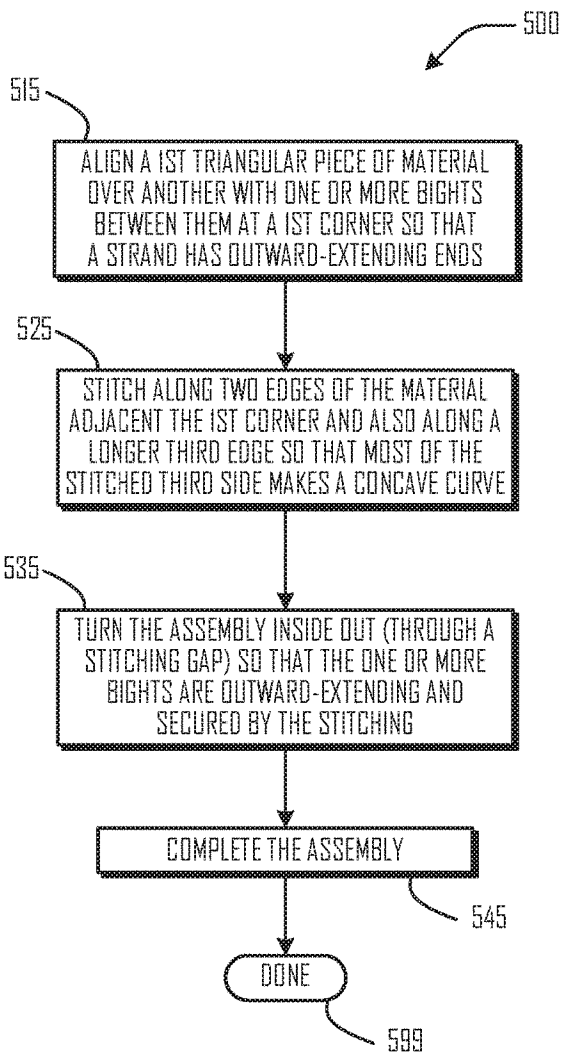
FIG. 5 depicts an infant care system assembly flow in accordance with one or more embodiments.

FIG. 5 illustrates an operational flow 500 suitable for use in assembling one or more inventive infant care systems described herein. As will be recognized by those having ordinary skill in the art, not all events of infant care system configuration are illustrated in FIG. 5. Rather, for clarity, only those steps reasonably relevant to describing the atypical assembly are shown and described. Those having ordinary skill in the art will also recognize the present embodiment is merely one exemplary embodiment and that variations on that embodiment may be made without departing from the scope of the broader invention described herein.

Operation 515 depicts aligning a first triangular piece of material over another with one or more bights between them at a corner so that the strand has outward-extending ends (positioning a strand 305 with outward-extending ends 302 and one or more inward-extending bights 301 as shown between the pieces 311, 312, e.g.).

Operation 525 depicts stitching along two edges of the material adjacent the first corner and also along a longer third edge so that most of the stitched third side makes a concave curve and the stitching is continuous except at a stitching gap formed along the first edge (stitching along edges 351, 352 adjacent corner 341 and also along edge 353 so that most of the stitched third side 463 makes a concave curve, e.g.). This can occur, for example, in a context in which the strand is a woven material and in which the stitching 460 is continuous except at a stitching gap 465 formed along the first edge 461, e.g.).

Operation 535 depicts turning the assembly inside out so that the bight(s) at the first corner is outward-extending and secured by the stitching (inverting assembly 400 by passing the stitched-in strand and the pieces 311, 312 through gap 465 so that part of strand 305 becomes an outwardly-extending bight of strand 105, e.g.). This can occur, for example, after any extra peripheral material (more than ⅜ inch from stitching 460, e.g.) is trimmed off.

Operation 535 depicts completing the assembly, such as by placing additional stitching to close the gap, by adding complementary engagement components (snap sides 131, 132 or Velcro® hook-and-loop strips, e.g.), and by adding one or more infant care appliances (engaging a pacifier or toy, e.g.). This can occur, for example, in a context in which the infant care system would otherwise require protruding metal parts not well suited for running through a tumble dryer.

Operation 599 concludes flow 500. Infant care systems made according to flow 500 are exceedingly inexpensive for what they do, so effective for appliance retention that they may even be used as a unitary disposable product. This can occur, for example, even in a context in which any other appliance-retention bib design would be commercially unfeasible as a unitary disposable product.

Although various flow operations are presented in sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Figure 6:
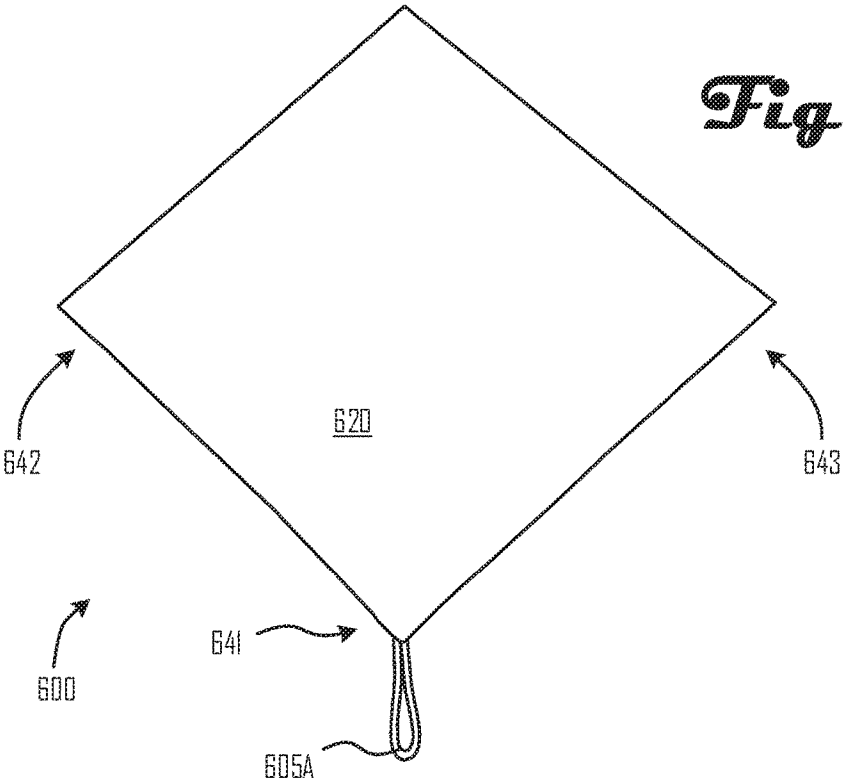
FIG. 6 depicts an infant care system configured to grip an infant care appliance in accordance with one or more embodiments.

Referring now to FIG. 6, there is shown an infant care system 600 in which one or more inventive technologies may be present as described below. Infant care system 600 includes (at least) a four-sided bib body 620 having several corners 641, 642, 643 and edges as shown. Extending from a first corner 641 is a part of one or more strands 605A configured to grip an infant care appliance.

Figure 7:
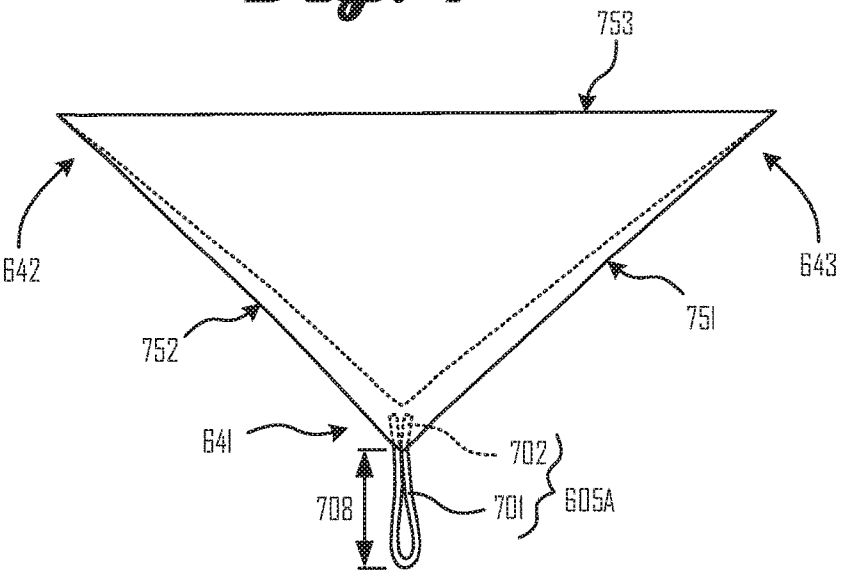
FIG. 7 depicts the infant care system of FIG. 8 in a different position, showing additional features.

Referring now to FIG. 7, there is shown another view of the infant care system 600 of FIG. 6, in which one or more inventive technologies may be present. With the top half of body 620 folded down and behind the bottom half, three primary edges 751, 752, 753 are evident, the longest edge 753 of which is folded and (nominally) straight. As shown, body 620 may be made of single-ply cloth to which one or more strands 605A (each having one or more downward-extending bights 701 and upward-extending ends 702, e.g.) are stitched, adhesed, or otherwise affixed (at a corner 641 opposite the longest edge 753, e.g.). The effective length of the body 620 (measured from the effective circumference to an endmost point of corner 641, e.g.) is between 6 and 12 inches as shown. The part of the one or more strands 605A extending beyond body 620 is between 1 and 4 inches in length 708 as shown. It is contemplated, however, that any of these parameters may vary outside these ranges. The effective circumference is determined by how the clip, knot, or other affixation mechanism (not shown) that couples opposite corners 642, 643 is configured in use.

Figure 8:
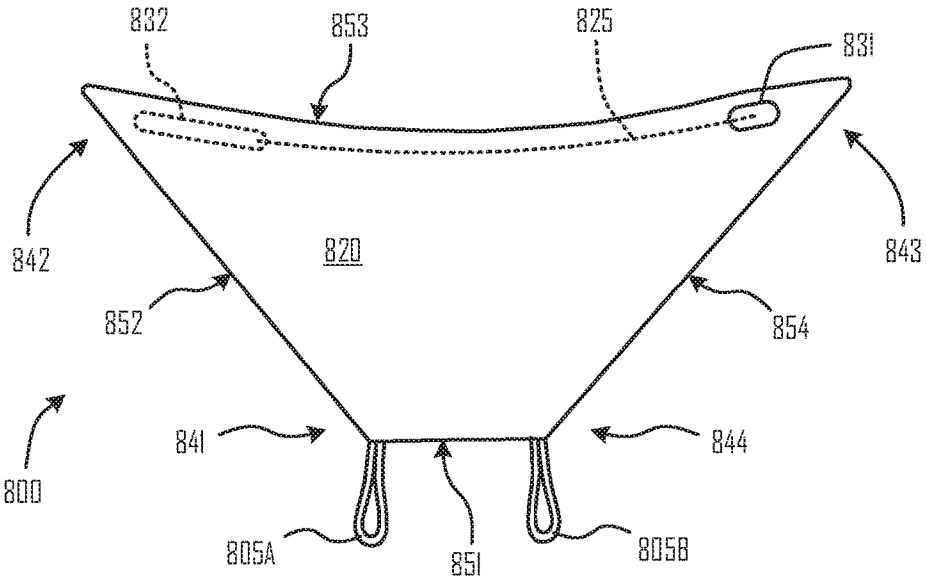
FIG. 8 depicts an infant care system having a (nominally) trapezoidal shape.

Referring now to FIG. 8, there is shown an infant care system 800 in which one or more inventive technologies may be present. Infant care system 800 includes a (nominally) trapezoidal or other quadrilateral bib body 820 having several corners 841, 842, 843, 844 and edges 851, 852, 853, 854 as shown. Extending from a first corner 841 is a part of one or more strands 805A configured to grip a first infant care appliance. Likewise extending from another corner 844 is a part of one or more other strands 805B configured to grip a second infant care appliance. FIG. 8 also depicts a "first" fastener side 831 and range of positions of a "second" fastener side 832 to which the first side 831 can be affixed (with an adhesive or hook-and-loop mechanism such as Velcro®, e.g.) by which the bib size (effective circumference 825) can be adjusted.

Figure 9:
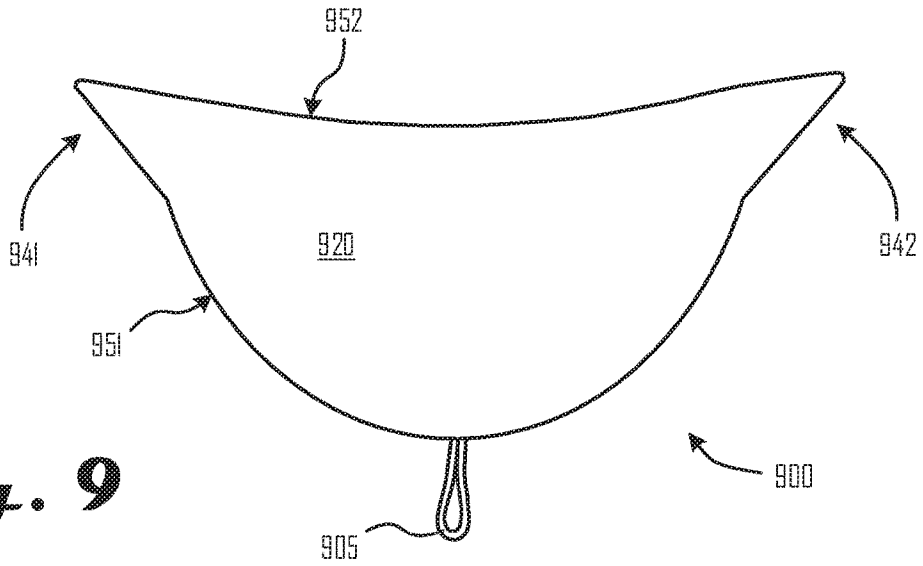
FIG. 9 depicts an infant care system having a (nominally) semicircular shape.

Referring now to FIG. 9, there is shown an infant care system 900 in which one or more inventive technologies may be present. Infant care system 900 includes a (nominally) semicircular other curved bib body 920 having at least a primary convex edge 951, a primary concave edge 952, and a plurality of corners 941, 942 as shown. Extending from the primary convex edge 951 is a part of one or more strands 905 configured to grip a first infant care appliance. Various knots, clips, pins, buttons, or other fastening assemblies (not shown) may be used for fastening opposite corners 941, 942 in use.

Figure 10:
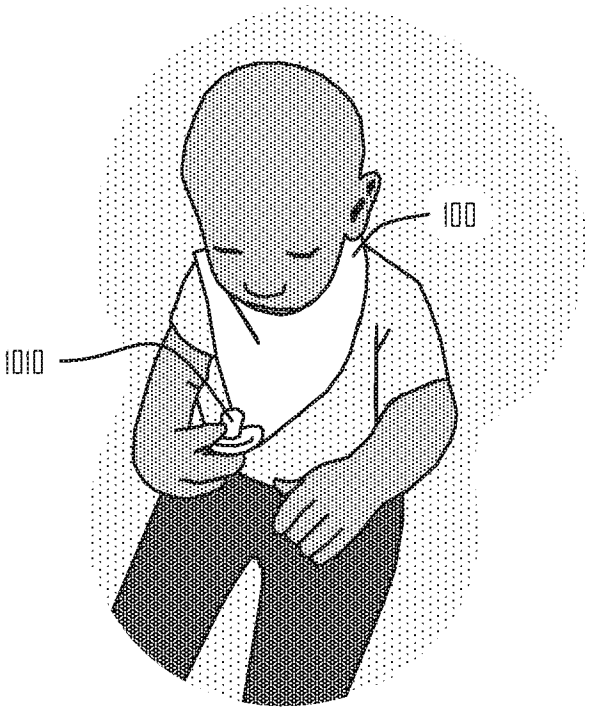
FIG. 10 depicts a single-piece, machine-washable infant care system in use on an infant.

Referring now to FIG. 10, there is shown a single-piece, machine-washable infant care system 100 in use, optionally one that exemplifies infant care systems as described above. Infant care system 100 comprises a bib having first and second ends (like corners 142, 143 of FIG. 1, e.g.) and a hanging portion, wherein the first end has a first attachment feature (like snap side 131, e.g.), wherein the second end has a second attachment feature (like snap side 132, e.g.) configured to releasably engage the first attachment feature, and wherein the hanging portion (like corner 141 and additional components to which it is coupled, e.g.) includes a first bight (like bight 301, e.g.) configured to grip part of a pacifier 1010 or other infant care appliance.

In some variants, a primary edge of the bib extends between the first and second ends/corners and defines a curved recess (like recess 293, e.g.) that tapers to a point adjacent each of the first and second ends. This allows the bib to assume a saddle shape without substantial stretching along its sides (causing less than 5% elongation at edges 151, 152 thereof, e.g.), allowing the bib to lay smoothly against the abdomen of an infant in normal use. (The "saddle shape" refers here to the bib bending back at its ends and forward at its top and bottom when worn by a seated infant as shown.) With the recess having a generally arcuate shape with an average radius of curvature on the order of 80 inches (along at least half the length of edge 153, e.g.), the bib's top edge appears to be straight while allowing extra material along the descending edges (as described above) to accommodate outward protrusion at the wearer's abdomen more smoothly than a straight bib top would.

Alternatively or additionally, the hanging portion may (optionally, in some variants) include a body 120 having a lowest corner (like corner 141, e.g.) configured so that the first bight extends a length 108, 708 of more than 2 inches or less than 3 inches beyond the body.

Alternatively or additionally, an instance of the bib may include a woven cord (a braided, acrylic-containing instance of strand 105, e.g.) having two ends sewn adjacent one another and between first and second cloth layers, and wherein stitching along an edge of the first and second cloth layers secures the first bight.

Alternatively or additionally, the bib may include exactly two snap assembly configurations of significantly different effective sizes by virtue of having a single snap side (like snap side 131, e.g.) at the first end (less than 3 inches from an endmost point thereof, e.g.) and a pair of second snap sides at the second end (like a first snap side 132A being 3-5 inches from an endmost point thereof and a second snap side 132B being closer to the endmost point than to the first snap side of the second end, e.g.), either of which may be coupled to the first snap side in a selectable manner (to accommodate a larger or smaller wearer, e.g.).

Figure 11:
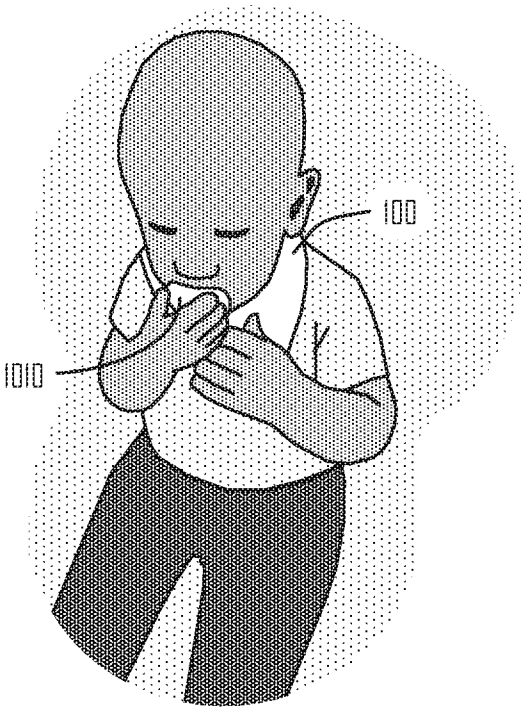
FIG. 11 depicts a manner in which the infant can use the single-piece, machine washable infant care system of FIG. 10 with little or no assistance from a caregiver.

FIG. 11 illustrates a manner in which the infant can, with some variants of infant care systems described herein, obtain and self-administer an appliance manually with little or no assistance from a caregiver. This may provide a significant advantage for infants in the care of a busy person, especially in a context in which an infant would otherwise be unable see, identify, grasp, and use the appliance without assistance. Alternatively or additionally, an advantage may be felt in a context in which the caregiver is so busy that the infant care system would otherwise be used in an incomplete state of assembly (as an ordinary bib, while separated to facilitate washing one part or another, e.g.).

Figure 12:
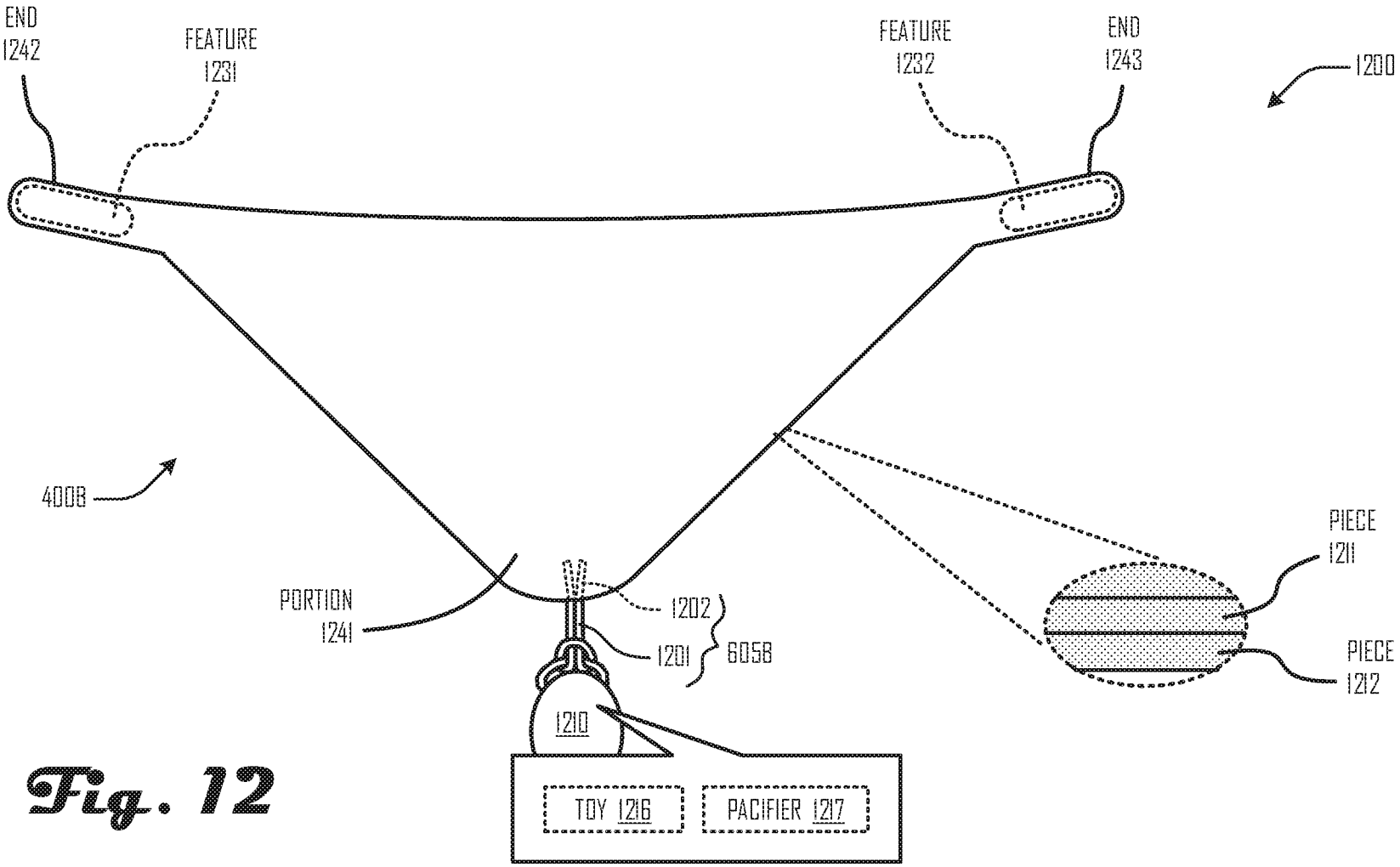
FIG. 12 depicts another infant care system comprising a bib assembly 400B in which one or more inventive technologies may be present.

Referring now to FIG. 12, there is shown another infant care system 1200 comprising a bib assembly 400B in which one or more inventive technologies may be present. Assembly 400B may include a hanging portion 1241 and first and second ends 1242, 1243 (like corners 142, 143 of FIG. 1, e.g.). The respective ends 1242, 1243 may include magnetic or other attachment features 1231, 1232 (hooks or buttons, e.g.) configured to releasably engage one another. The hanging portion 1241 may include one or more (bights 1201 and ends 1202 of) strands 605B configuring to engage one or more infant care appliances 1210 so that one or more infant care appliances 1210 remain within reach of an infant who is wearing the system 1200. For example such appliances 1210 may include one or more toys 1216, pacifiers 1217, cups, or the like. In some variants the bib assembly 400B may include two or more pieces 1211, 1212 overlain as shown.

In light of teachings herein, numerous existing techniques may be applied for adapting wearable articles or devices as described herein without undue experimentation. See, e.g., U.S. Pat. No. 9,162,813 ("Pacifier holder and protector"); U.S. Pat. No. 8,460,053 ("Toy attachment systems and methods"); U.S. Pat. No. 8,118,268 ("Hands free baby bottle holder and feeder"); U.S. Pat. No. 7,086,121 ("Non-removable snap fastener used to attach a pacifier, teething ring, toy or other article to any garment of children's clothing"); U.S. Pat. No. 7,640,598 ("Infant caregiver padded pillow garment"); U.S. Pat. No. 7,032,248 ("Multipurpose baby and toddler bib"); U.S. Pub. No. 20150150312 ("Clothing clip apparatus and method for using same"); U.S. Pub. No. 20110258748 ("Pacifier-bearing-bib"); U.S. Pub. No. 20080134432 ("'Binket' miniature security blanket with attachment device for a pacifier or other soothing apparatus for children"); and U.S. Pub. No. 20070061939 ("Reconfigurable mealtime accessory tote for organizing and transporting mealtime accessories to remote meal locations, and protecting the clothing of young children during mealtime when using the same"). These documents are incorporated herein by reference to the extent not inconsistent herewith.

With respect to the numbered clauses and claims expressed below, those skilled in the art will appreciate that recited operations therein may generally be performed in any order. Also, although various operational flows are presented in a sequence(s), it should be understood that the various operations may be performed in other orders than those which are illustrated or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise. Also in the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

CLAUSES 1. (Independent) A infant care method comprising:

configuring a bib assembly 400 to have a hanging portion 1241 and first and second ends 1242, 1243 (like corners 142, 143 of FIG. 1, e.g.) and so that the first end 1242 has a first attachment feature 1231 and so that the second end has a second attachment feature 1232 complementary to the first attachment feature 1231 (configured to engage with a hook-and-loop or snapping affixation, e.g.); and configuring the second attachment feature 1232 to releasably engage the first attachment feature 1231, wherein the hanging portion 1241 includes a first bight 605 configuring to engage one or more infant care appliances 1210.

2. The infant care method ANY of the above clauses, wherein the stitching along the two edges of the material adjacent the first corner and also along a longer third edge is performed so that more than half of (a length of) the stitched third side makes a concave curve.

3. The infant care method ANY of the above clauses, wherein the stitching along the two edges of the material adjacent the first corner and also along a longer third edge is performed so that more than half of the stitched third side makes a concave curve and so that the stitching 460 is continuous except at a stitching gap 465 formed along the first edge.

4. The infant care method ANY of the above clauses, wherein the stitching along the two edges of the material adjacent the first corner and also along a longer third edge is performed so that more than half of the stitched third side makes a concave curve and so that the stitching 460 is continuous except at a single stitching gap 465.

5. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

configuring exactly two snap assembly configurations of significantly different effective sizes by virtue of having a single snap side (like snap side 131, e.g.) at the first end (less than 3 inches from an endmost point thereof, e.g.) and a pair of second snap sides at the second end (like a first snap side 132A being 3-5 inches from an endmost point thereof and a second snap side 132B being closer to the endmost point than to the first snap side of the second end, e.g.), either of which may be coupled to the first snap side in a selectable manner (to accommodate a larger or smaller wearer, e.g.).

6. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

configuring a (braided or other) woven cord having two ends sewn adjacent one another and between first and second cloth layers, and wherein stitching along an edge of the first and second cloth layers secures the first bight.

7. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

configuring the hanging portion to include a body 120 having a lowest corner (like corner 141, e.g.) so that the first bight extends a length 108, 708 of more than 2 inches beyond the body.

8. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

configuring the hanging portion to include a body 120 having a lowest corner (like corner 141, e.g.) so that the first bight extends a length 108, 708 of less than 3 inches beyond the body.

9. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

trimming a surplus of peripheral material 483 off the material (at least) along the longer third edge 753.

10. The infant care method ANY of the above clauses, wherein configuring the bib assembly 400 to have the hanging portion 1241 and the first and second ends 1242, 1243 and so that the first end 1242 has a first attachment feature 1231 and so that the second end has a second attachment feature 1232 complementary to the first attachment feature 1231 comprises:

trimming a surplus of peripheral material 483 off the material (at least) along the longer third edge 753 so as to form a recess having a generally arcuate shape with an average radius of curvature within an order of magnitude of 80 inches (along at least half the length of edge 153, e.g.).

11. The infant care method ANY of the above clauses, wherein configuring the second attachment feature 1232 to releasably engage the first attachment feature 1231 comprises:

allowing the bib assembly to assume a saddle shape on an infant so that the first and second ends 1242, 1243 thereof bend back while a top and bottom thereof bend forward.

12. The infant care method ANY of the above clauses, wherein configuring the second attachment feature 1232 to releasably engage the first attachment feature 1231 comprises:

allowing the bib assembly to assume a saddle shape without substantial stretching along its sides so that the bib lays smoothly against an abdomen of an infant in normal use.

13. The infant care method ANY of the above clauses, wherein configuring the second attachment feature 1232 to releasably engage the first attachment feature 1231 comprises:

affixing the first and second attachment features 1231, 1232 together with a hook-and-loop engagement.

14. The infant care method ANY of the above clauses, wherein configuring the second attachment feature 1232 to releasably engage the first attachment feature 1231 comprises:

affixing the first and second attachment features 1231, 1232 together with a snapping engagement.

15. The infant care method ANY of the above clauses, further comprising: supporting a pacifier 1217 by the first bight, wherein the one or more infant care appliances 1210 include the pacifier 1217.

While various system, method, article of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting, with the true scope and spirit being indicated in the final claim set that follows.

What is claimed is:

1. An infant care method comprising:

configuring a bib assembly to have a hanging portion and first and second ends and so that said first end has a first attachment feature and so that said second end has a second attachment feature complementary to said first attachment feature, wherein said configuring said bib assembly comprises:

aligning a first triangular piece of material over another with one or more bights between them at a corner thereof so that a strand that comprises a first bight has outward-extending ends;

stitching along first and second edges of said material adjacent said first corner and also along a third edge that is longer than said first edge and than said second edge;

trimming a surplus of peripheral material off said material along said longer third edge;

turning said assembly inside out so that said one or more bights at said first corner are outward-extending and secured by stitching; and configuring said second attachment feature to releasably engage said first attachment feature, wherein said hanging portion includes said first bight configured to engage one or more infant care appliances and whereby said one or more infant care appliances remain within reach of an infant who is wearing said bib assembly.

2. The infant care method of claim 1, further comprising:

supporting a pacifier by said first bight, wherein said one or more infant care appliances include said pacifier.

3. The infant care method of claim 1, wherein said stitching along said two edges of said material adjacent said first corner and also along a longer third edge is performed so that more than half of said stitched third side makes a concave curve.

4. The infant care method of claim 1, wherein said stitching along said two edges of said material adjacent said first corner and also along a longer third edge is performed so that more than half of said stitched third side makes a concave curve and so that said stitching is continuous except at a single stitching gap formed along said first edge.

5. An infant care method comprising:

configuring a bib assembly to have a hanging portion and first and second ends and so that said first end has a first attachment feature and so that said second end has a second attachment feature complementary to said first attachment feature, wherein said configuring said bib assembly comprises:

aligning a first triangular piece of material over another with one or more bights between them at a corner thereof so that a strand that comprises a first bight has outward-extending ends;

stitching along first and second edges of said material adjacent said first corner and also along a third edge that is longer than said first edge and than said second edge;

turning said assembly inside out so that said one or more bights at said first corner are outward-extending and secured by stitching; and configuring said second attachment feature to releasably engage said first attachment feature, wherein said hanging portion includes said first bight configured to engage one or more infant care appliances.

6. The infant care method of claim 5, wherein said configuring said bib assembly to have said hanging portion and said first and second ends and so that said first end has a first attachment feature and so that said second end has a second attachment feature complementary to said first attachment feature comprises:

configuring exactly two snap assembly configurations of significantly different effective sizes by virtue of having a single snap side at said first end and a pair of second snap sides at said second end, either of which may be coupled to said first snap side in a selectable manner.

7. The infant care method of claim 5, wherein said configuring said bib assembly to have said hanging portion and said first and second ends and so that said first end has a first attachment feature and so that said second end has a second attachment feature complementary to said first attachment feature comprises:

configuring a woven cord having two ends sewn adjacent one another and between first and second cloth layers, and wherein stitching along an edge of said first and second cloth layers secures said first bight.

8. The infant care method of claim 5, wherein said configuring said bib assembly to have said hanging portion and said first and second ends and so that said first end has a first attachment feature and so that said second end has a second attachment feature complementary to said first attachment feature comprises:

configuring said hanging portion to include a body having a lowest corner so that said first bight extends a length of more than 2 inches beyond said body.

9. The infant care method of claim 5, wherein said configuring said bib assembly to have said hanging portion and said first and second ends and so that said first end has a first attachment feature and so that said second end has a second attachment feature complementary to said first attachment feature comprises:

configuring said hanging portion to include a body having a lowest corner so that said first bight extends a length of less than 3 inches beyond said body.

10. The infant care method of claim 5, wherein said configuring said bib assembly to have said hanging portion and said first and second ends and so that said first end has a first attachment feature and so that said second end has a second attachment feature complementary to said first attachment feature comprises:

trimming a surplus of peripheral material off said material along said longer third edge.

11. The infant care method of claim 5, wherein said configuring said second attachment feature to releasably engage said first attachment feature comprises:

allowing said bib assembly to assume a saddle shape on an infant so that said first and second ends thereof bend back while a top and bottom thereof bend forward.

12. The infant care method of claim 5, wherein said configuring said second attachment feature to releasably engage said first attachment feature comprises:

affixing said first and second attachment features together with a hook-and-loop engagement.

13. The infant care method of claim 5, wherein said configuring said second attachment feature to releasably engage said first attachment feature comprises:

affixing said first and second attachment features together with a snapping engagement.

14. The infant care method of claim 5, further comprising:

supporting a pacifier by said first bight, wherein said one or more infant care appliances include said pacifier.

* * * * *